United States Patent [19]

Wright

[11] 4,095,698

[45] Jun. 20, 1978

[54] MODULAR STORAGE RACK SYSTEM

[76] Inventor: C. E. Wright, 70 Denrose Dr., Tonawanda, N.Y. 14150

[21] Appl. No.: 710,734

[22] Filed: Aug. 2, 1976

[51] Int. Cl.[2] ..... A47F 5/00

[52] U.S. Cl. ..... 211/126; 211/71; 211/189; 312/111

[58] Field of Search ..... 211/74, 71, 75, 126, 211/189; 248/68 CB; D7/71; 220/234, 229; 312/108, 111; 46/26

[56] References Cited

U.S. PATENT DOCUMENTS

| | | | |
|---|---|---|---|
| 2,364,007 | 11/1944 | Stanton | 312/257 R X |
| 3,086,674 | 4/1963 | Scheverman | 220/229 |
| 3,315,402 | 4/1967 | Scott et al. | 220/229 X |
| 3,581,929 | 6/1971 | Guenard et al. | 211/74 UX |
| 3,754,805 | 8/1973 | Pangburn et al. | 312/111 |
| 3,765,629 | 10/1973 | Voelker et al. | 248/68 CB |
| 3,856,246 | 12/1974 | Sinko | 248/68 CB |
| 3,984,004 | 10/1976 | Devanney | 211/71 X |

FOREIGN PATENT DOCUMENTS

| | | | |
|---|---|---|---|
| 2,001,630 | 1/1971 | Germany | 248/68 CB |
| 427,207 | 6/1967 | Switzerland | D7/71 X |
| 1,202,519 | 8/1970 | United Kingdom | 211/74 |
| 1,330,786 | 9/1973 | United Kingdom | 211/74 |

*Primary Examiner*—Roy D. Frazier
*Assistant Examiner*—Robert W. Gibson, Jr.
*Attorney, Agent, or Firm*—Gravely, Lieder & Woodruff

[57] ABSTRACT

A storage rack system of modular construction which comprises a plurality of pre-cut parts which are joined together in an array to receive storage containers. The storage containers can be cans, bottles, jars, tubes, etc. The pre-cut parts are limited to a small number of uniform shapes and sizes so that a person with minimal mechanical ability will nevertheless be able to construct the storage rack. The system is designed so that the storage containers themselves provide the principal structural support for the storage rack system.

4 Claims, 12 Drawing Figures

MODULAR STORAGE RACK SYSTEM

BACKGROUND OF THE INVENTION

In home workshops, etc., storage space or lack thereof is often a problem. Another problem frequently encountered is quick retrieval of materials. These problems are generally solved by constructing shelves or cabinets to store materials such as nails, screws, nuts, bolts, and other small items. The major problems with these manufactured storage devices are: (1) cost; (2) improper length, height, or depth; (3) lack of sturdiness; and (4) corrosion. What is desired, then, is an inexpensive, durable storage system, of variable dimensions, which will resist rust.

It is therefore, a primary object of this invention to provide a storage system which can be constructed at extremely low cost. It is a further object to provide a storage system which can be of variable dimensions so that it can be placed in space that is available in a crowded workshop. It is a further object to provide an easily assembled storage system that will resist corrosion and be otherwise durable. These and other objects and advantages will be apparent hereinafter.

SUMMARY OF THE INVENTION

A storage rack system of modular construction which comprises a plurality of pre-cut parts. The parts are joined in an array so that storage containers can be received in open apertures in the array. The pre-cut parts may be furnished in kits so that a consumer, of limited mechanical ability, can construct the rack system by himself. The pre-cut parts and the rack system are designed so that the storage containers provide the principal structural support for the system.

DESCRIPTION OF THE DRAWINGS

In the drawings, wherein like numbers refer to like parts wherever they occur.

DETAILED DESCRIPTION

Figure 1:
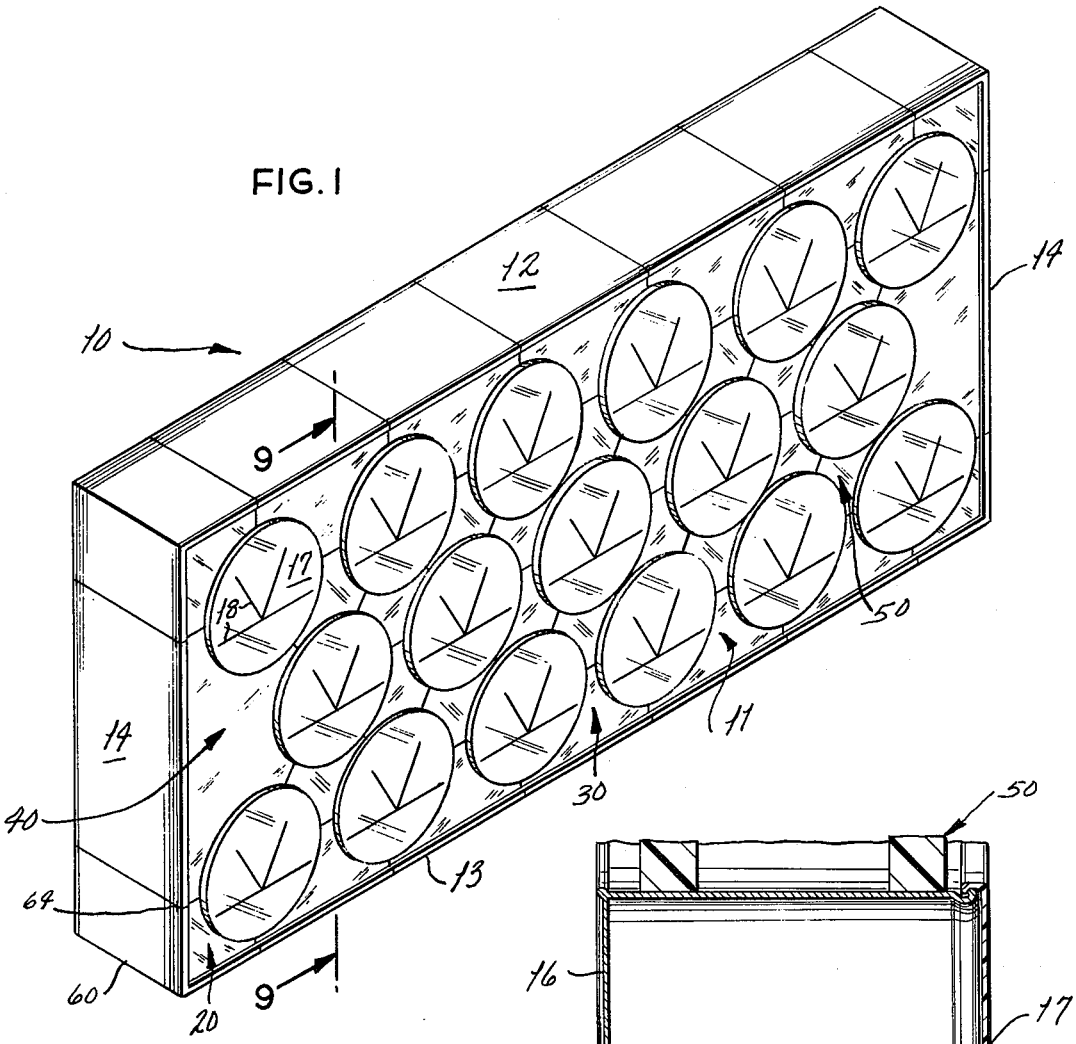
FIG. 1 is a perspective view showing an assembled storage rack of this invention.
Figure 9:
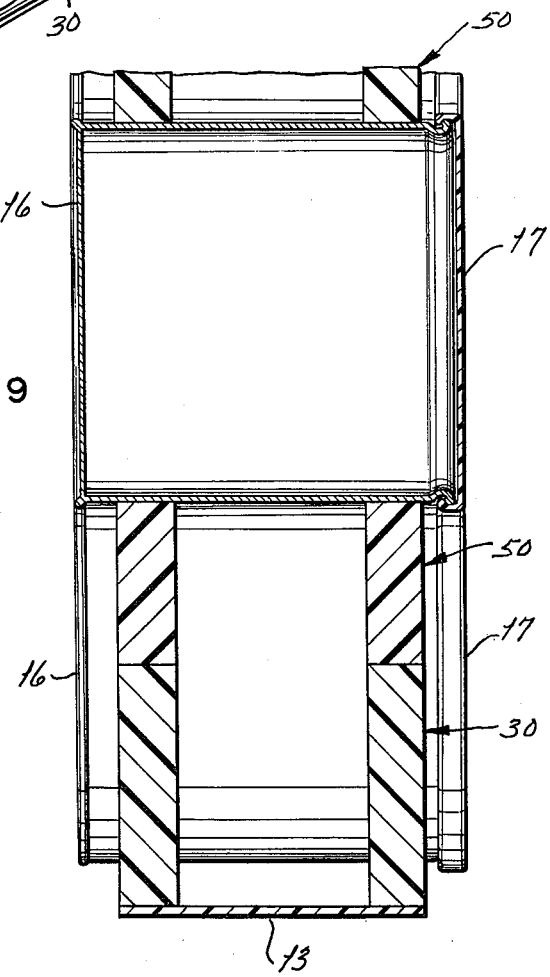
FIG. 9 is a sectional view taken along line 9—9 of FIG. 1.
Figure 10:
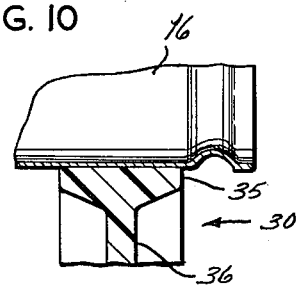
FIG. 10 is a sectional view taken along line 10—10 of FIG. 2.

FIG. 1 shows a completed storage rack 10 which has been constructed from the elements of the present invention. The front panel 11 and the rear panel (not shown) of the rack 10 are constructed from pre-cut members which will be described in more detail hereinafter. The top panel 12, the base panel 13 and the end panels 14 are made from tongue-and-grooved members and are fastened together at their ends by post members

Figure 2:
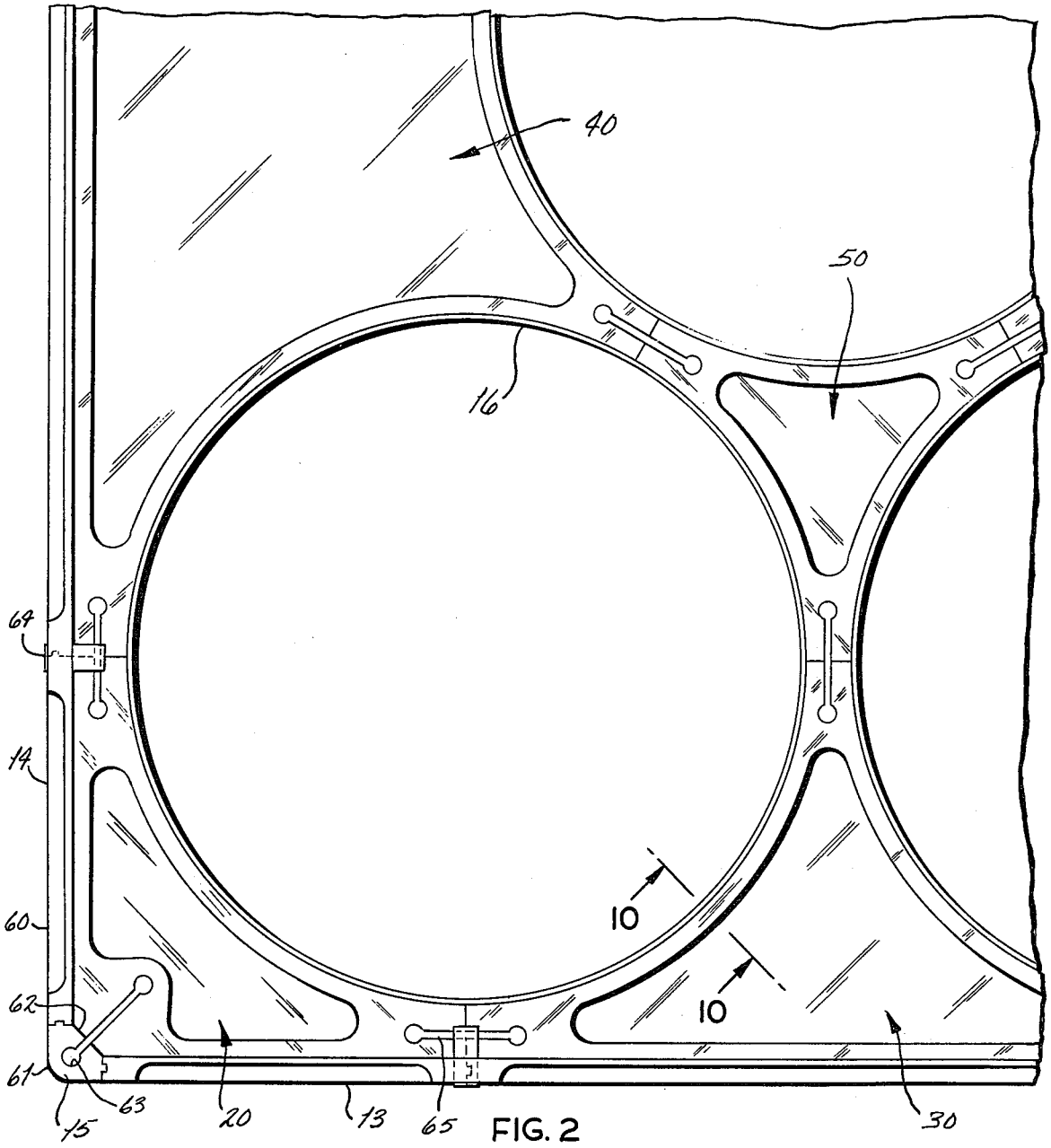
FIG. 2 is a fragmentary enlarged front view of the rack assembly of FIG. 1 with the lids removed from the storage members.
Figure 3:
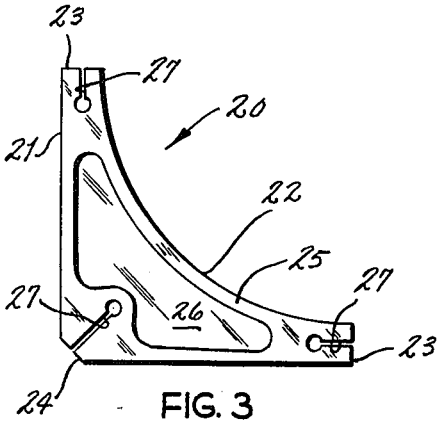
FIG. 3 is a front elevational view of a corner piece.
Figure 4:
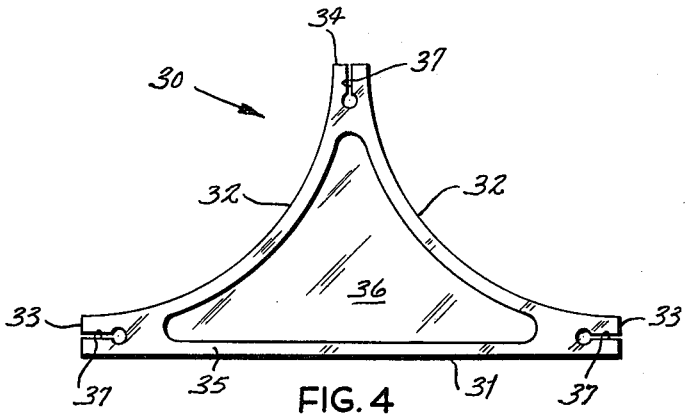
FIG. 4 is a front elevational view of a base piece.
Figure 5:
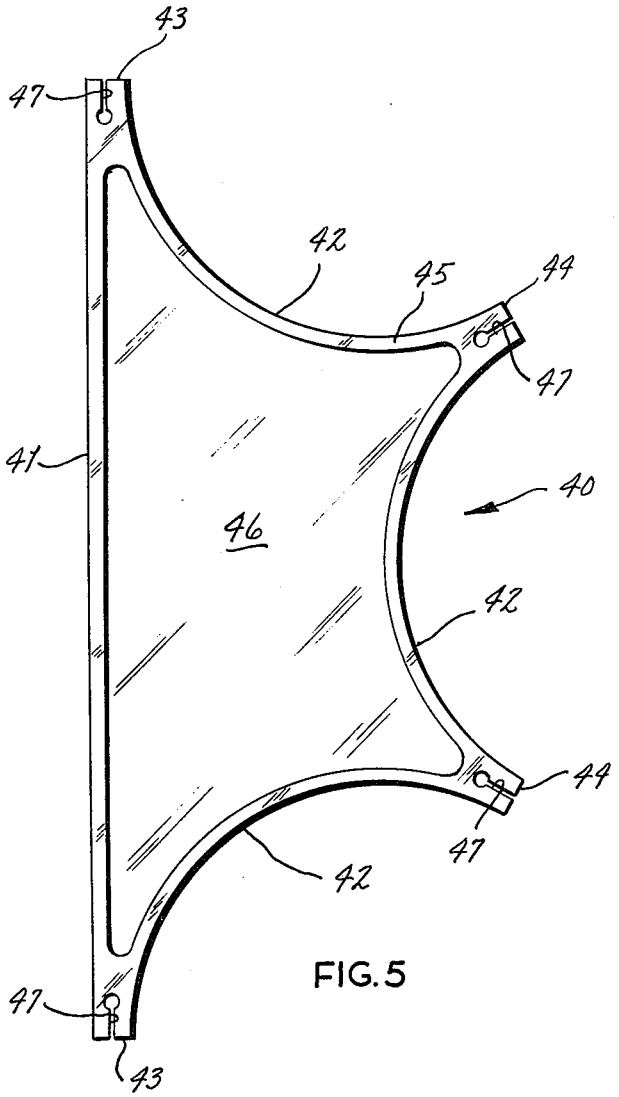
FIG. 5 is a front elevational view of an end piece.

15 (FIG. 2). The storage elements 16 are containers, such as coffee cans, tobacco cans, glass jars, plastic jars, paperboard tubes, etc. The elements 16 may be fitted with snap-on plastic caps 17 which may be slit at 18 to provide access to the interior of the receptacle 16 without removing the lid 17.

The pieces which are used to form the front and rear panels 11 are described in detail as follows:

(A) Corner: The corner pieces 20 have planar side faces 21 which are disposed in right angular relationship to each other. On its inwardly presented side, the corner piece 20 has an arcuate surface 22. The arcuate surface 22 is connected to the planar sides 21 by narrow planar abutment surfaces 23. Opposed to the arcuate surface 22 is a third planar abutment surface 24 which connects the sides 21. The corner piece 20 has a peripheral flange 25 and reduced center sections 26 to save weight and material. At the corners opening out to the faces 23 and 24 are key ways 27 which are adapted to receive retainers (not shown).

(B) Base: The base pieces 30 have a planar back face 31 and inwardly presented opposed arcuate surfaces 32. The arcuate surfaces 32 are connected to the planar back face by abutment surfaces 33 and are separated from each other by a narrow planar abutment surface 34. The base piece 30 has a peripheral flange 35 and a reduced center section 36. At the corners opening out to the abutment faces 33 and 34 are key ways 37 which are adapted to receive retainers (not shown).

(C) End: The end piece 40 has a planar back face 41 and three inwardly presented arcuate surfaces 42. The two outermost arcuate surfaces 42 are separated from the back face 41 by abutment surfaces 43 and are separated from the center arcuate surface 42 by abutment surfaces 44. The end piece 40 has a peripheral flange 45 and a reduced center web portion 46. Opening out to the abutment faces 43 and 44 are key ways 47 adapted to receive fastening means (not shown).

(D) Triangular Filler Parts: The triangular filler member 50 has three arcuate surfaces 41 located on 120° centerlines. Each of the arcuate surfaces 51 is separated from the next by a narrow abutment surface 52 which is planar. The filler member 50 has a peripheral flange 53 and a reduced central web portion 54. Opening out to each of the abutment faces 52 are key ways 55 to receive fastening means (not shown).

ASSEMBLY OF RACK OUTER FRAME

The top panel 12, the base panel 13 and the end panel 14 are made of rectangular pieces 60 which are sized to mate with the side faces 21 of the corner piece 20 and the back faces 31 and 41 of the base piece 30 and the end pieces 40 respectively. At each corner of the rack 10 are corner posts 15 which have a curved outer surface 61 and a planar inner surface 62 which mates with the corner piece abutment surface 24 (FIG. 2). The post inner surface has a key way 63 which aligns with the key way 27 of the corner piece 20.

The corner post 15 and the adjacent panal piece 60 have a tongue-and-groove connection. At the joints between the panels 60 are fastening means 64 which can be clips, clamps, spring retainers, etc., to hold the adjacent panels 60 together. Preferably, bendable aluminum strips about 0.030 inch by ¼ inch are inserted behind the keys, bent outwardly, and slipped through slots in the panels. Then they are bent again to hold the panels inwardly.

ASSEMBLY OF FRONT AND REAR PANELS

As the rack 10 is of modular construction, there is no inherent limit to the size of the front and rear panels. The size of rack 10 and the panels is determined by the number of storage compartments 16 desired. As the number of storage compartments 16 is increased, the length of the top panel 12, the base 13 and the end panels 14 is increased accordingly.

Figure 7:
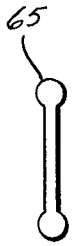
FIG. 7 is a front elevational view of a retainer.
Figure 8:
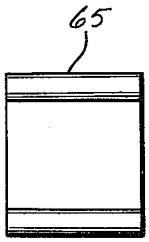
FIG. 8 is a side elevational view of a retainer.
Figure 6:
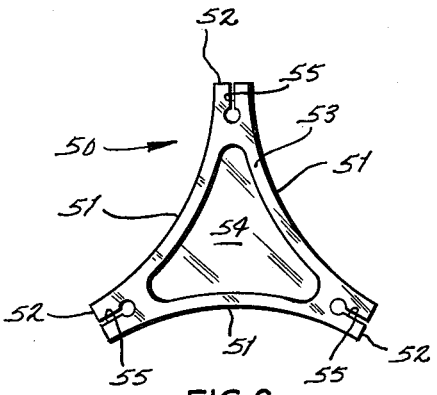
FIG. 6 is a front elevational view of a filler piece.

In assembling the rack 10, the corner pieces 20 are joined to a post 15 by means of a suitable retainer 65 (FIGS. 7 and 8) which slips into the key ways 27 and 63. The corner pieces 20 also are joined to base pieces 30 and end pieces 40 by means of similar retainers 65 inserted into key ways 27 and 37 and 27 and 47 respectively. The rack 10 is built to the desired width and height by adding additional base pieces 30, end pieces 40, and panels 60.

The cans or storage elements 16 are securely positioned between the corner 20, the base 30, and the end 40 when these are assembled. By positioning a filler 50 around the receptacle 16 and fastening it to the base 30 and the end 40 by means of keys 65 inserted into the key ways 55 and 37 and 55 and 47 respectively, an integral unit is assembled wherein the storage element 16 becomes a principal load bearing part of the structure. Fillers are also used in the interior portion of the front (or rear) panel in order to provide the desired amount of separation between the receptacles in the interior portion of these panels.

To complete the assembly, the remainder of the top, base, and end panels 60 are slid into assembled relationship and secured by the fastening means 64.

The elements which are assembled to make the final rack 10, e.g., the parts which make up the top, base, and end panels 12, 13, and 14, and the front face 11 and back face 12, preferably are made from a low cost plastic, such as polystyrene foam, since the principal structural strength of the array is derived from the containers 16, the plastic need have only meager strength properties.

The final rack 10 has utility as a storage bin or rack for hardware, hobby supplies, sewing supplies, electronic parts, pipe fittings, blueprints, or as a wire rack or tubing rack, etc.

The overall shape of the rack 10 can be varied by varying the shape of the components which make up the top, base, and end panels 12, 13, and 14, and the back face 12 and the front face 11. The receptacles 16 can be of any length and for longer receptacles open ended metal tubes can be soldered together. Intermediate face panels such as 11 and 12 may also be added.

When lids 17 are used on the receptacles 16, the receptacles 16 are positioned sufficiently far apart to allow removal of the lids 17 without interference. If clear or slightly opaque plastic is used for the lid 17, one can see into the storage container 16 while the lid is affixed.

Also racks 10 can be set back-to-back with the closed ends of the receptacles 16 juxtaposed to form a storage wall accessible from both sides.

The use of the receptacles 16 as part of the structure of the rack 10 results in an efficient use of material and allows the remainder of the rack structure to be of lighter weight material. The arrangement of bins 16 shown in the drawings results in an even distribution of the load imposed by the contents of the bins 5 and the dead weight of the rack throughout the structure.

The foregoing description discloses a method of joining the various modular parts by means of key ways (e.g. 27, 37, 47, 55) and retainer 65. The parts may also be joined by bonding the parts with cement or glue, such as epoxy cement, etc. If a bonding method is used, retainers are not required (but may optionally be used), and key ways need not be formed, i.e., the various modular parts may be essentially planar, and the abutment surfaces 23, 24, 34, 43, 44, 52 may be free of key ways.

Figure 11:
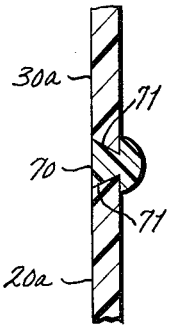
FIG. 11 is a fragmentary sectional view of a modified end joint.
Figure 12:
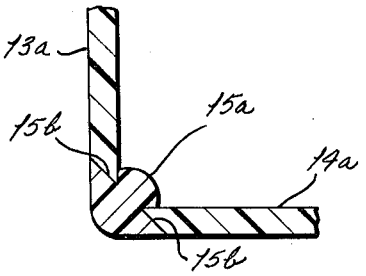
FIG. 12 is a fragmentary sectional view of a modified corner joint.

This modified arrangement is shown in FIGS. 11 and 12. In this modification, the corner posts $15^a$ are urethane strips with grooves $15^b$ formed therein into which the end panels $13^a$, $14^a$, and $15^a$ fit. The corner pieces $20^a$ and adjacent base pieces $30^a$ and end pieces $40^a$ are joined by urethane strips 70 which have opposed grooves 71 to retain the pieces in engagement. The other flat plastic pieces are bonded to each other and to the receptacle by white glue or other suitable adhesives.

What is claimed is:

1. Modular storage system comprising a front panel having apertures therethrough, a rear panel identical to said front panel and having apertures axially aligned with the apertures of the front panel, said front panel and the rear panel comprising a plurality of pre-cut parts assembled in predetermined relation, end, top, and base panels having a combined length equal to the perimeter of the front panel, means for attaching said end panel to the front panel and to the rear panel to separate the front panel and the rear panel, at least one storage container having an axial length greater than the distance separating the front and the rear panel and secured into an aperture of the front panel and into an aligned aperture of the rear panel, wherein said pre-cut parts of the front and rear panels include corner pieces having means for abutting the adjacent end, top, or base panels and a curved surface which engages a storage container, base pieces having means to abut another base piece or a corner piece and one top or base panel and includes two curved surfaces which engage storage container, and side pieces having means to abut another side piece or a corner piece and one end panel and includes three curved surfaces for engaging storage containers, and spacer pieces having means for abutting another spacer piece, a base piece or a side piece and three curved surfaces for engaging storage containers, and means for releasibly or permanently engaging the abutting surfaces of said corner pieces, said side pieces, said base pieces, and said spacer pieces.

2. The storage system of claim 1 wherein the end panel comprises engagable sections including corner posts, means engaging the corner posts with said corner pieces, said engagable sections having means for releasibly engaging the next adjacent engagable section and means for releasibly engaging the engagable sections adjacent to each corner post to said post.

3. The storage systems of claim 1 wherein the top panel comprises engagable sections including corner posts, means engaging the corner posts with said corner pieces, said engagable sections having means for releasibly engaging the next adjacent engagable section and means for releasibly engaging the engagable section adjacent to each corner post to said post.

4. The storage systems of claim 1 wherein the base panel comprises engagable sections including corner posts, means engaging the corner posts with said corner pieces, said engagable sections having means for releasibly engaging the next adjacent engagable section and means for releasibly engaging the engagable section adjacent to each corner post to said post.

* * * * *